United States Patent [19]

Honickman

[11] Patent Number: 4,508,231

[45] Date of Patent: Apr. 2, 1985

[54] WALL UNIT

[76] Inventor: Reuben Honickman, 66 Collier St., Suite 4B, Toronto, Ontario, Canada, M4W 1L9

[21] Appl. No.: 240,515

[22] Filed: Mar. 4, 1981

[51] Int. Cl.[3] ..... A47F 5/00

[52] U.S. Cl. ..... 211/199; 52/458; 52/594; 160/236; 211/189; 248/220.2

[58] Field of Search ..... 211/189, 193, 169, 208, 211/88, 126, 186, 199; 160/236; 248/223.3, 224.4, 224.3, 225.3, 220.2; 52/457, 458, 594

[56] References Cited

U.S. PATENT DOCUMENTS

| | | | |
|---|---|---|---|
| 2,926,729 | 3/1960 | Zanini | 160/236 |
| 3,489,290 | 1/1970 | Larson | 211/190 |
| 3,547,472 | 12/1970 | Ehrmon | 52/594 X |
| 3,684,103 | 8/1972 | Bellinder | 211/189 |
| 3,871,435 | 3/1975 | Lopatka | 211/186 X |
| 4,126,230 | 11/1978 | Tyson et al. | 211/88 X |
| 4,323,163 | 4/1982 | Johns | 211/189 |
| 4,339,487 | 7/1982 | Mullet | 52/458 X |

FOREIGN PATENT DOCUMENTS

| | | | |
|---|---|---|---|
| 2296389 | 7/1976 | France | 211/193 |

*Primary Examiner*—Robert W. Gibson, Jr.

[57] ABSTRACT

The disclosure relates to a wall unit of the type to which shelves and other article supports can be fitted and which can be used, for example, as part of a store display structure. In a preferred embodiment, the unit is made up of an assembly of identical plastic extrusions stacked one on top of the other, in which each extrusion defines a number of laterally directed channels so that the assembly defines an array of parallel channels in the outer surface of the unit. Each channel is designed so that an article supporting element can be engaged therein.

8 Claims, 11 Drawing Figures

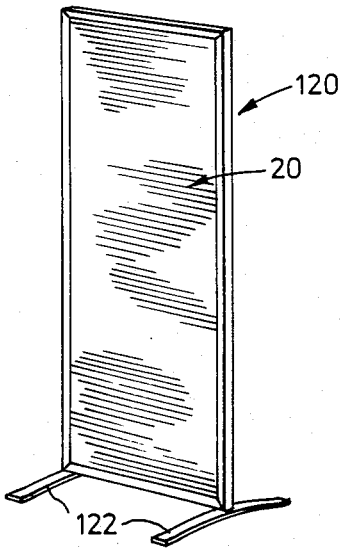
FIG. 9
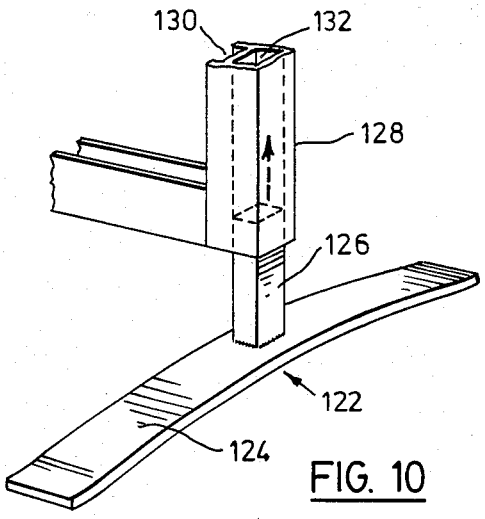
FIG. 10
FIG. 8
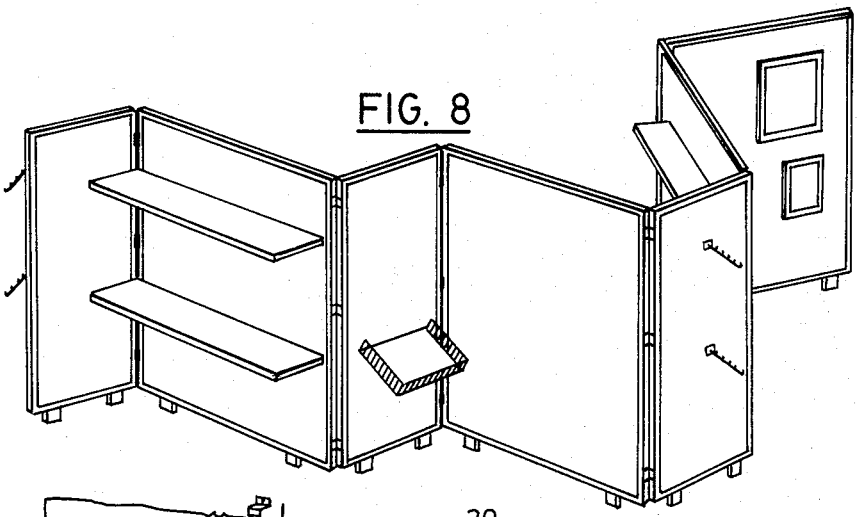
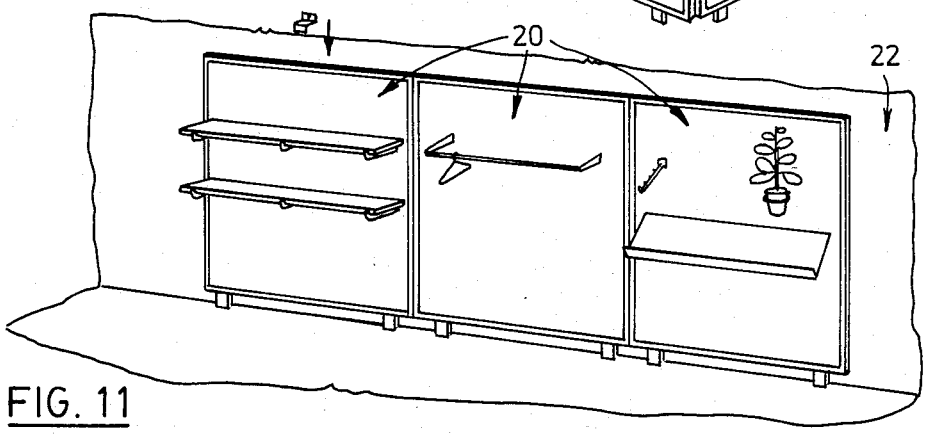
FIG. 11

WALL UNIT

This invention relates to wall units of the type to which shelves and other article supports can be fitted, and which can be used, for example, as part of display structures in stores.

My U.S. Pat. No. 4,186,666 discloses an example of a wall unit of this type. In that case, the wall unit has an outer surface formed with an array of openings which cover substantially the whole of said surface and which are arranged in a multiplicity of vertical and horizontal rows. Article supporting elements can be engaged in selected ones of the openings and thereby appropriately positioned on the outer surface of the unit. This form of wall unit has been found to be eminently satisfactory in many practical applications. However, in some cases, it would be desirable to provide for infinite variation in the horizontal positioning of the article supporting elements across the face of the unit.

Examples of prior art display structures having a facility for infinite lateral adjustment of article supporting elements are shown by U.S. Pat. Nos. 3,067,882 (Ribbens et al.) and 4,008,807 (Phillips). Ribbens is concerned with a suspension filing rack while Phillips relates to a display device for shoes. As such, neither of these prior art references is directly related to wall units as such. In both cases, the structure disclosed is relatively cumbersome and would not be suitable for use in the environment with which the present invention is particularly concerned.

An object of the present invention is to provide a wall unit of the same general type as that disclosed in my United States patent mentioned above, but which has provision for infinite horizontal adjustment of article supporting elements adjusted with the unit.

The unit provided by the present invention includes a plurality of elongate members extending transversely of the unit over at least substantially its entire width, each member having parallel upper and lower surfaces and the members being arranged in superposed relationship with the lower surface of an upper member supported on an upper surface of the member below. Each member is of uniform cross-sectional shape throughout its length and includes at least one laterally directed channel which opens into an outer surface of the wall unit, whereby said outer surface is provided with an array of parallel transverse channels. Each channel has a lip at its lower end so that an article supporting element to be fitted to the unit can be engaged over said lip and thereby retained in the channel at any of an infinite number of positions spaced along the channel.

In order that the invention may be more clearly understood, reference will now be made to the accompanying drawings which illustrate a number of preferred embodiments by way of example, and in which:

FIG. 8 is a perspective view showing a display structure comprising a number of wall units hinged together by connections of the form shown in FIG. 7;

FIG. 9 is a perspective view of a free-standing form of wall unit according to a further embodiment of the invention;

FIG. 10 is detail perspective view of part of FIG. 9, shown partly exploded; and, FIG. 11 is a perspective view showing three wall units in accordance with the invention secured directly to an existing wall surface.

Figure 1:
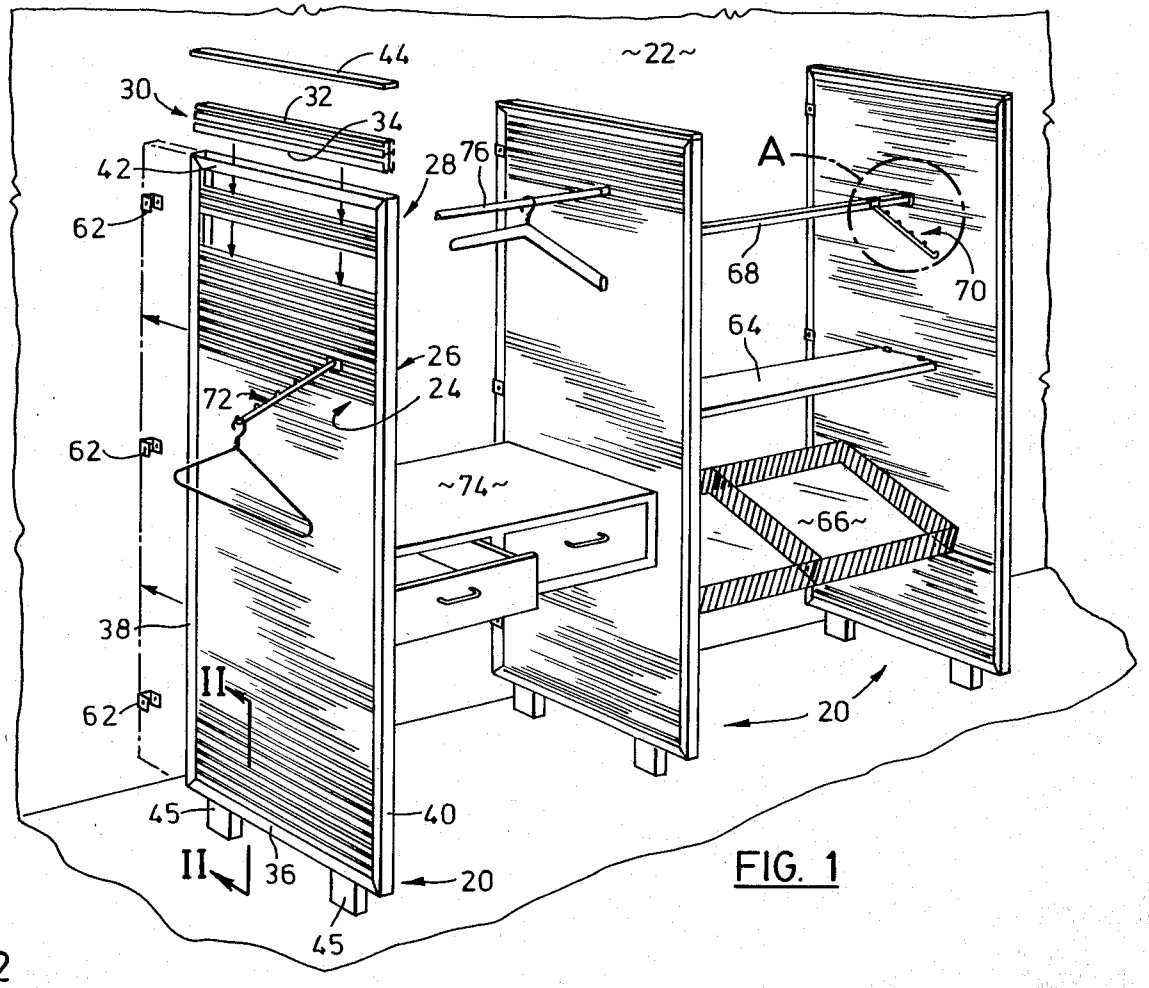
FIG. 1 is a partly exploded perspective view of a display structure incorporating three wall units of the form provided by the invention.

Referring first to FIG. 1, three identical wall units of the form provided by the invention are shown in spaced parallel positions extending outwardly from and generally normal to an existing wall surface. Each wall unit is generally denoted by reference numeral 20 and the wall surface is indicated at 22. Each unit is generally vertically disposed and is of relatively narrow and flat rectangular form having opposed outer surfaces indicated at 24 and 26 in the case of the unit shown at the left. With continued reference to that unit, it will be seen that, in this particular embodiment, each unit comprises a peripheral frame 28 and a plurality of elongate members 30 which extend transversely of the unit over at least substantially its entire width. One of these members is shown in an exploded position above frame 28 and it will be seen by reference to that member that it has parallel upper and lower surfaces 32 and 34 respectively. The vertical arrows below that member are intended to indicate that, in their normal positions, the members are arranged in superposed relationship with the lower surface of an upper member supported on an upper surface of the member below. In other words, the members are stacked one on top of the other within frame 28.

Figure 2:
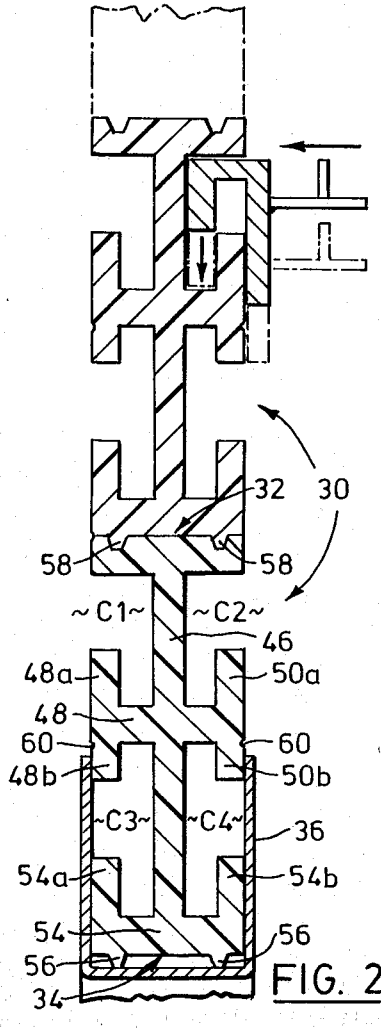
FIG. 2 is a vertical sectional view on line II—II of FIG. 1.

FIG. 2 shows the two bottom members in the stack in cross-section and will be described in more detail later. However, it should first be noted that frame 28 comprises four inwardly facing channel section members connected at their corners by mitred joints. In this embodiment, the channel section members are made of steel and are welded together at the corners. The bottom channel member is shown in cross-section at 36 in FIG. 2. The two side members 38 and 40 (FIG. 1) are essentially the same but the top member 42 is open at the top (i.e. has no base) so that the elongate members 30 can be in effect "loaded" into the frame through the open top of member 42. After the wall unit has been assembled, a capping strip 44 can be secured over the open top of member 42 using sheet metal screws. The capping strip will be used where the top of the frame is below eye level but would not normally be used in a relatively tall structure such as that shown in FIG. 1.

Welded to the bottom frame member 36 are a pair of vertical feet in the form of rectangular section tubular members 45 which serve to support the frame clear of the floor.

Reference will now be made more particularly to FIG. 2, in describing the wall unit members 30. Each member is of uniform cross-sectional shape throughout its length and includes four laterally directed channels, two at each side, which open into the respective outer surfaces of the wall unit as assembled. Referring back to FIG. 1, it will be appreciated that, as a consequence of the cross-sectional shape of the members 30, the outer surfaces of the unit are each provided with an array of parallel transverse channels. As will be more particularly described below, each channel has a lip along its lower side so that an article supporting element to be fitted to the unit can be engaged over the lip and thereby retained in the channel at any of an infinite number of positions spaced along the channel.

In this embodiment, the members 30 are in the form of plastic extrusions and are all identical. In fact, the members may all be formed by sections severed transversely from the same continuous plastic extrusion. A rigid acrylic plastic material is used and may be self-coloured according to the finish required in the assembled wall unit. The plastic material may even be transparent or semi-transparent if required.

Referring to the lowermost member 30 shown in FIG. 2 by way of example, it will be seen that the member includes a vertical web 46 disposed generally normal to the upper and lower surfaces 32 and 34. At the midpoint of its height, horizontal web portions 48 and 50 extend outwardly from web 46 and have respective upper and lower vertical lips 48*a* and 48*b* and 50*a* and 50*b* respectively. The upper and lower surfaces 32 and 34 are defined by corresponding webs 52 and 54 which are of the same width as the total width of webs 48 and 50 and which define with those webs the four channels referred to above; the channels are denoted by reference characters C1 to C4. The lips 48*a* and 50*a* extend along the lower sides of the two uppermost channels C1 and C2 and corresponding lips 54*a* and 54*b* are provided for the lower channels C3 and C4. Channels C3 and C4 also have depending lips 48*b* and 50*b* along their upper edges. While these lips are not necessary for most of the article supporting elements which will be used with the wall unit, they are provided in case it may be desirable in some cases to positively interlock a component with the channel, for example by sliding it into the channel from the end, so as to positively prevent removal of the component from the outer surface of the wall unit.

It will also be seen from FIG. 2 that the lower surface of each member 30 is provided with a pair of parallel spaced ribs, denoted 56, which protrude from the surface, and that the upper surface 32 of the member is provided with a pair of complimentary grooves 58. These ribs and grooves of vertically adjacent members interfit as shown to locate the members laterally with respect to one another so that the members are always properly aligned in the assembled unit. It will also be noted that the depending ribs 48*b* and 50*b* at the centre of each member are provided with small grooves denoted 60 in their outer faces. These grooves are also provided for the sake of appearance in that they match with the joint line which will be visible from the exterior of the unit at the point where vertically adjacent members meet.

Figure 3:
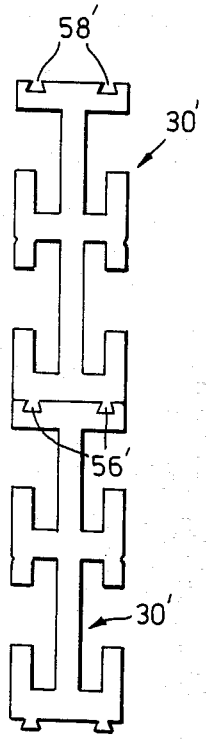
FIG. 3 is a view similar to FIG. 2 illustrating an alternative embodiment of the invention.

Before referring in more detail to FIG. 1 and describing the form of the article supporting elements used with the wall unit, it may be convenient to refer to FIG. 3 which illustrates a modification of the cross-sectional shape of the members 30. In FIG. 3, reference numeral 30' has been used to denote the modified form of member. The member is essentially the same as that shown in FIG. 2 except that the ribs 56 and grooves 58 in the lower and upper surfaces of each member respectively are of dovetail shape so that vertically adjacent members can be interlocked with one another. The ribs and grooves are denoted respectively by reference numerals 56' and 58' in FIG. 3. This arrangement has the advantage that the members can be coupled together to form a wall unit without the need for a rigid frame as frame 28. In this embodiment, the frame could be replaced by a simple trim strip, e.g. of flexible plastic material fitted over the sides and top and bottom edges of the assembled wall unit members. A unit of this form would probably not be sufficiently rigid to be self-supporting but could, for example, be secured directly onto an existing wall surface.

Other methods of interlocking the members can of course be employed. For example, the ribs and grooves could be of shapes other than the dovetail shape shown. In another modification, the opposed faces of vertically adjacent members could be provided with aligned T-shaped grooves which could then receive a matching locking strip slid longitudinally into the grooves from the end.

Referring back to FIG. 1, the three wall units 20 are essentially identical and have been shown mounted in parallel positions as forming part of a display structure. The units are secured to the existing wall 22 by U-shaped brackets three of which are shown at 62 in association with the left hand wall unit. Each bracket is secured to the existing wall surface so that its limbs project from the surface in vertical, spaced positions in which they can receive one of the vertical side members of the frame of the wall unit. The wall unit can then be attached to the brackets using self-tapping screws.

FIG. 1 also illustrates how a number of article supporting elements can be engaged with the wall units. For example, a shelf 64, an inclined rack 66 and a square-section rod 68 are supported between the wall unit shown at the extreme right and the centre unit. Rod 68 carries a garment support 70 such as might be used in a store for carrying a rack of garments. A similar support 72 is engaged with the unit shown at the left. Between that unit and the centre unit is a drawer assembly 74 and a clothes hanger rod 76.

Figure 4:
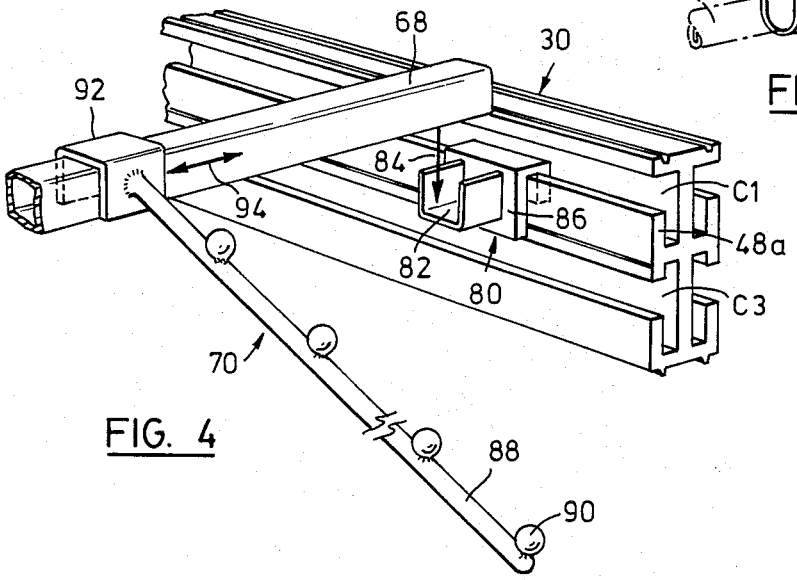
FIG. 4 is a detail perspective view of the part of FIG. 1 indicated in ghost outline at A.
Figure 5:
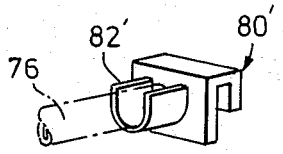
FIGS. 5 and 6 are detail perspective views of alternative forms of article supporting elements which may be used with the wall unit provided by the invention.
Figure 6:
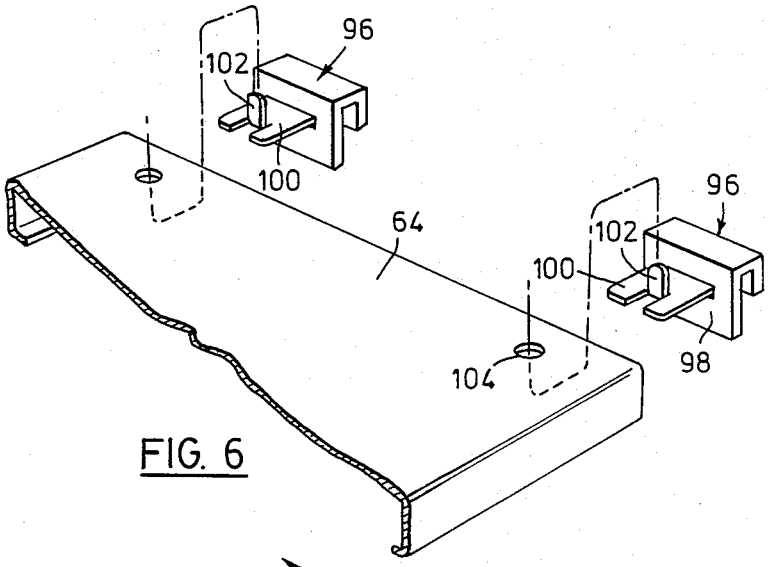

FIGS. 4, 5 and 6 illustrate in detail the form of article supporting elements which are engaged with the wall units to support these components and those elements will now be described primarily with reference to those figures.

FIG. 4 shows the garment support 70 in association with one of the channel section members 30 of the wall unit 20 which appears at the right in FIG. 1. Rod 68 extends between that wall unit and the centre wall unit 20 and is supported at its ends by fitments engaged with appropriate members of the respective wall units, and one of which is shown at 80 in FIG. 4. Fitment 80 is moulded in a plastic material and defines and open topped channel 82 into which the rod 68 can be engaged from above as indicated by the arrow 84 in that view. Channel 82 projects outwardly from what might be termed as an inverted channel section member 86 dimensioned to engage in the appropriate channel of member 30 and hook over the lip at the lower end of the channel. In FIG. 4, the fitment is shown engaged in channel C1 of member 30 and engaged over lip 48*a* although it could of course be engaged with the lower channel C3.

FIG. 5 shows a modified form of the fitment 80 (denoted 80') in which the channel section member 82 is replaced by a member having the cross-sectional shape of a curved U (denoted 82') suitable for receiving a rod (such as the rod 76 shown in FIG. 1) which is of circular shape in cross-section. Thus, the clothes hanger rod 76 is supported in essentially the same fashion as the rod 68 of garment support 70.

Referring back to FIG. 4, garment support 70 includes an arm 88 which extends downwardly from rod 68 in an inclined position and which is fitted with spaced projections 90 forming stops against which a garment hanger can be restrained. This form of hanger would typically be used in a store type of display in which the garments are required to be displayed "face on" to the customer. At its upper end, arm 88 is secured to a channel section member 92 dimensioned to snugly fit over rod 68 as shown while permitting lateral adjustment of the position of arm 88 as indicated by arrow 94. It has been found in practice that, provided member 92 is a good fit on rod 68, arm 88 will be retained sufficiently securely to permit it to carry a full load of garments without becoming detached from the rod. In this embodiment, arm 88, projections 90 and channel member 92 are all made of metal and are secured together by welding. In practice, the welded assembly would probably be chrome plated or plastic coated to provide an attractive appearance.

Referring back to FIG. 1, the garment support 72 shown engaged with the outer face of the left hand wall unit 20 is essentially of similar form to support 70 except that the associated channel member (corresponding to member 92—FIG. 4) will be of a somewhat narrower channel shape so as to fit snugly over the relevant lip of the member 30 with which it is engaged.

FIG. 6 shows part of the shelf 64 shown in FIG. 1, and two essentially identical fitments 96 by which the shelf is secured to the relevant wall unit. Part of one end only of the shelf has been shown in FIG. 6 and it will of course be understood that similar fitments will be provided at the opposite end of the shelf. Each fitment 96 includes an inverted channel section member 98 which is similar to the member 86 shown in FIG. 4 in that it is dimensioned to fit snugly over the lip associated with any one of the channels of wall unit member 30. Projecting horizontally outwardly from the vertical limb of the member 98 is a web 100 which has a vertical tongue 102 arranged to engage through an appropriately positioned hole 104 in the shelf 64 itself. Again, the fitments 96 will be plastic mouldings.

Figure 7:
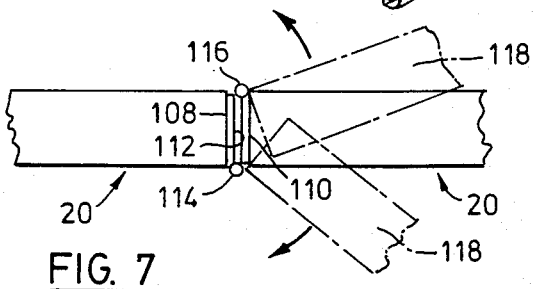
FIG. 7 is a detail plan view showing a hinge connection which may be used between two adjacent wall units.

FIGS. 7 and 8 illustrate the manner in which a plurality of wall units assembled from the channel section members 30 can be hinged together to form an adjustable free-standing structure which could be used, for example, to display articles in a store, or as office partitioning. FIG. 7 shows generally a double hinge assembly 106 which is secured between adjacent wall units 20. Hinge assembly 106 includes two hinge plates 108 and 110 secured (for example by self tapping screws not shown) to opposed faces of the adjacent vertical side members of the peripheral frames of the two units, and a centre plate 112 to which the plates 108 and 110 are connected by hinge pins 114 and 116. The ghost outlines 118 indicate how this form of hinge allows the units to be articulated with respect to one another in either direction. Of course, two simple plate hinges could be used where double articulation is not required.

FIG. 8 shows how several units can be secured together side by side using either the double articulation type hinge assembly shown in FIG. 7 or a conventional hinge. Normally, several hinges will be used between each two adjacent wall units. FIG. 8 also illustrates how the units themselves can be made of different sizes to provide different visual appearances. That view also shows various shelves, trays, garment supports and the like secured to the wall units. Again, these components can be attached in any appropriate configurations.

In FIG. 9 a free-standing structure 120 is shown and comprises a wall unit 20 of essentially the same form as that shown in FIG. 1, provided with feet 122. Thus, the wall unit 20 comprises a peripheral frame receiving a plurality of vertically stacked elongate members 30 of the form described with reference to FIG. 2. FIG. 10 shows the manner in which the feet 122 are fitted to the frame of the wall unit. It will be seen that each foot comprises a floor plate 124 which is slightly bowed at its centre and from which a vertical member 126 projects upwardly. In this case, the vertical frame members of the wall unit are of slightly different form from those previously described. One such member is indicated at 128 in FIG. 10 and it will be seen that that member includes not only an inwardly directed channel 130 for receiving the elongate members of the wall unit, but also a longitudinally extending passageway 132 dimensioned to closely receive the vertical member 126 of foot 122. Member 126 can be secured in passageway 132, for example by means of a self tapping screw inserted through member 128 and into member 126 if necessary.

Finally, FIG. 11 shows a display structure formed by three wall units 20 secured directly to an existing wall surface 22. Wall units 20 may be of exactly the same form as the wall units shown in FIG. 1 (although of somewhat different proportions) and may be secured to wall 22 by screws extending through the peripheral frames of the units and into the wall 22. Alternatively, clips such as those indicated at 134 can be secured to the wall adjacent the wall unit and arranged so that outwardly extending limbs of the clips project in front of the unit and hold it back against the wall. In an alternative embodiment, one or more of the wall units 20 shown in FIG. 11 could comprise a plurality of interlocked elongate members 30' such as those shown in FIG. 3 as discussed in connection with that view. In that case, no rigid peripheral frame would be provided and the unit(s) would be supported by the wall.

It will of course be appreciated that an almost infinite possibility of combinations and arrangements of wall units is possible and that the examples shown in the drawings are to be considered as representative only. It should also be noted that numerous modifications are possible within the broad scope of the invention. For example, in the illustrated embodiments, the elongate members of the wall units are in the form of plastic extrusions, each of which defines four channels. However, it should be noted that a number of channels may vary; in minimum case, a single channel facing to one side only of the member may be provided, while in other cases even more than four channels could be provided. The elongate member may have channels opening to one side of the member only so that the resulting wall unit assembled from such members may have channels at one side only. Alternatively, the members within any one wall unit need not necessarily face in the same direction so that any one unit could have channels on both sides but defined by different members. The elongate members in any one wall unit need not necessarily be all the same. Also, it should be noted that some of the members could be "blanks"; that is, elongate members similar to one of the channel members but without any channels. It would even be possible to provide a wall unit with a plain panel in place of a group of elongate members so that part of the wall unit would be plain. The "modular" construction of the uhit makes it possible to assemble a number of elongate members in almost any combination to produce many widely differing forms of wall units. It should finally be noted that the elongate members need not necessarily be plastic. For example, metal extrusions could equally well be used.

I claim:

1. A wall unit having a frame including a pair of frame members arranged in generally vertical positions at opposite sides of the unit and defining respective channels which face one another; a stack of elongate members extending transversely of the unit between said frame members with opposite end portions of each said elongate member received within the channels of the respective frame members and dimensioned to permit free sliding movement of the elongate member along the frame member channels, each elongate member having parallel upper and lower surfaces and the elongate members being arranged in superposed relationship and resting on top of one another under the effect of gravity with the lower surface of an upper member supported on the upper surface of member below, wherein each said elongate member comprises a solid one-piece extrusion of uniform cross-sectional shape throughout its length having parallel upper and lower surfaces, the extrusion having a cross-sectional shape formed by respective top and bottom webs defining said upper and lower surfaces, a central web extending between the top and bottom webs generally centrally thereof and disposed generally normal to said upper and lower surfaces, respective intermediate webs which extend outwardly from said central web generally centrally thereof and which having respective upper and lower lips at their outer ends, said lower web including similar upwardly extending lips at its outer ends, whereby the webs define four laterally directed channels two at each side of said member and each of which has a lip extending along its lower edge so that an article supporting element to be fitted to the unit can be engaged in any of the channels defined by the elongate elements of the unit and can be engaged over the lip of the relevant channel and thereby retained in the channel at any of an infinite number of positions spaced therealong.

2. A wall unit as claimed in claim 1, wherein said parallel upper and lower surfaces of each member include complimentary formations extending longitudinally of the member and shaped to permit vertically adjacent members to be interengaged with one another and positively located laterally with respect to one another.

3. A wall unit as claimed in claim 2, wherein said formations are interlocking formations comprising complimentary dovetail section grooves and ribs, and wherein said vertically adjacent members are interlocked with one another by engagement of said ribs and grooves, whereby the members are both laterally located with respect to one another and are prevented from vertical separation.

4. A wall unit as claimed in claim 1, wherein said frame is formed by four relatively rigid frame members arranged in a rectangular configuration and including said pair of frame members.

5. A wall unit as claimed in claim 4, which is self-standing, wherein the assembly comprising said elongate members and said frame is relatively rigid, and wherein said frame is provided with supporting feet capable of maintaining said wall unit in a self-standing position.

6. A display structure comprising a plurality of wall units as claimed in claim 1 disposed in mutually parallel positions, wherein the elongate members in each unit are arranged so that opposing surfaces of the respective units include at least some of said parallel transverse channels; a plurality of article supporting elements extending between the respective units; and a corresponding plurality of fitments engaged in selected ones of said transverse channels and coupled to said article supporting elements, whereby said elements are engaged with the respective units.

7. A display structure comprising a plurality of wall units as claimed in claim 1, wherein the structure further comprises hinge means hingeably coupling said units together in edge-to-edge relationship, whereby the units can be articulated with respect to one another to vary the configuration of said structure.

8. An elongate member for use in a wall unit, said member comprising a solid one piece extrusion of uniform cross-sectional shape throughout its length having parallel upper and lower surfaces, the extrusion having a cross-sectional shape formed by respective top and bottom webs defining said upper and lower surfaces, a central web extending between the top and bottom webs generally centrally thereof and disposed generally normal to said upper and lower surfaces, respective intermediare webs which extend outwardly from said central web generally centrally thereof, and which have respective upper and lower lips at their outer ends, said lower web including similar upwardly extending lips at its outer ends, whereby said webs define four laterally directed channels two at each side of said member and each of which has a lip extending along its lower edge, so that said member can be arranged in vertically superimposed relationship with a plurality of like members to define a wall unit respective outer surfaces provided with an array of parallel transverse channels defined by the channels of said members.

* * * * *